United States Patent [19]

Curley

[11] Patent Number: 4,498,880

[45] Date of Patent: Feb. 12, 1985

[54] HURLABLE WATER RESCUE AID

[76] Inventor: Mark D. Curley, P.O. Box 296, Verdugo City, Calif. 91046

[21] Appl. No.: 455,538

[22] Filed: Feb. 22, 1983

[51] Int. Cl.[3] ..... B63C 9/16

[52] U.S. Cl. ..... 441/81; 441/93

[58] Field of Search ..... 441/6.9, 23, 92, 80, 441/93, 81, 94, 96, 97, 98, 99–101, 41, 83, 84, 85; 220/3, 96; 114/54

[56] References Cited

U.S. PATENT DOCUMENTS

| | | | |
|---|---|---|---|
| 1,766,182 | 6/1930 | Markus | 441/93 |
| 3,710,409 | 1/1973 | Davidson | 441/6 |
| 3,768,761 | 10/1973 | Cramer | 441/96 |
| 3,812,546 | 5/1974 | Witte | 441/97 |
| 3,886,612 | 6/1975 | Schnirel | 441/85 |
| 3,947,908 | 4/1976 | Maslenikow | 441/93 |
| 4,056,861 | 11/1977 | Cornforth | 411/85 |
| 4,232,417 | 11/1980 | Miller | 441/93 |

FOREIGN PATENT DOCUMENTS

| | | | |
|---|---|---|---|
| 782331 | 6/1935 | France | 441/92 |

*Primary Examiner*—Sherman D. Basinger
*Attorney, Agent, or Firm*—Wagner & Bachand

[57] ABSTRACT

Hurlable, water rescue aid 10 comprising an initially collapsed, gas-inflatable buoyancy element 12, a ball-shaped bracket 24 supporting the buoyancy element in collapsed condition generally within the locus of the bracket, a compressed gas supply 32 within the bracket for inflating said element, a penetrating tip 40, adapted to release the gas supply from the cylinder in advance of hurling the aid toward a person to be rescued, and passageways 52 metering flow of released gas from the supply into the buoyancy element, whereby the buoyancy element is substantially collapsed at the commencement of flight but substantially inflated at the termination of flight for use by the person.

16 Claims, 6 Drawing Figures

HURLABLE WATER RESCUE AID

TECHNICAL FIELD

Figure 1:
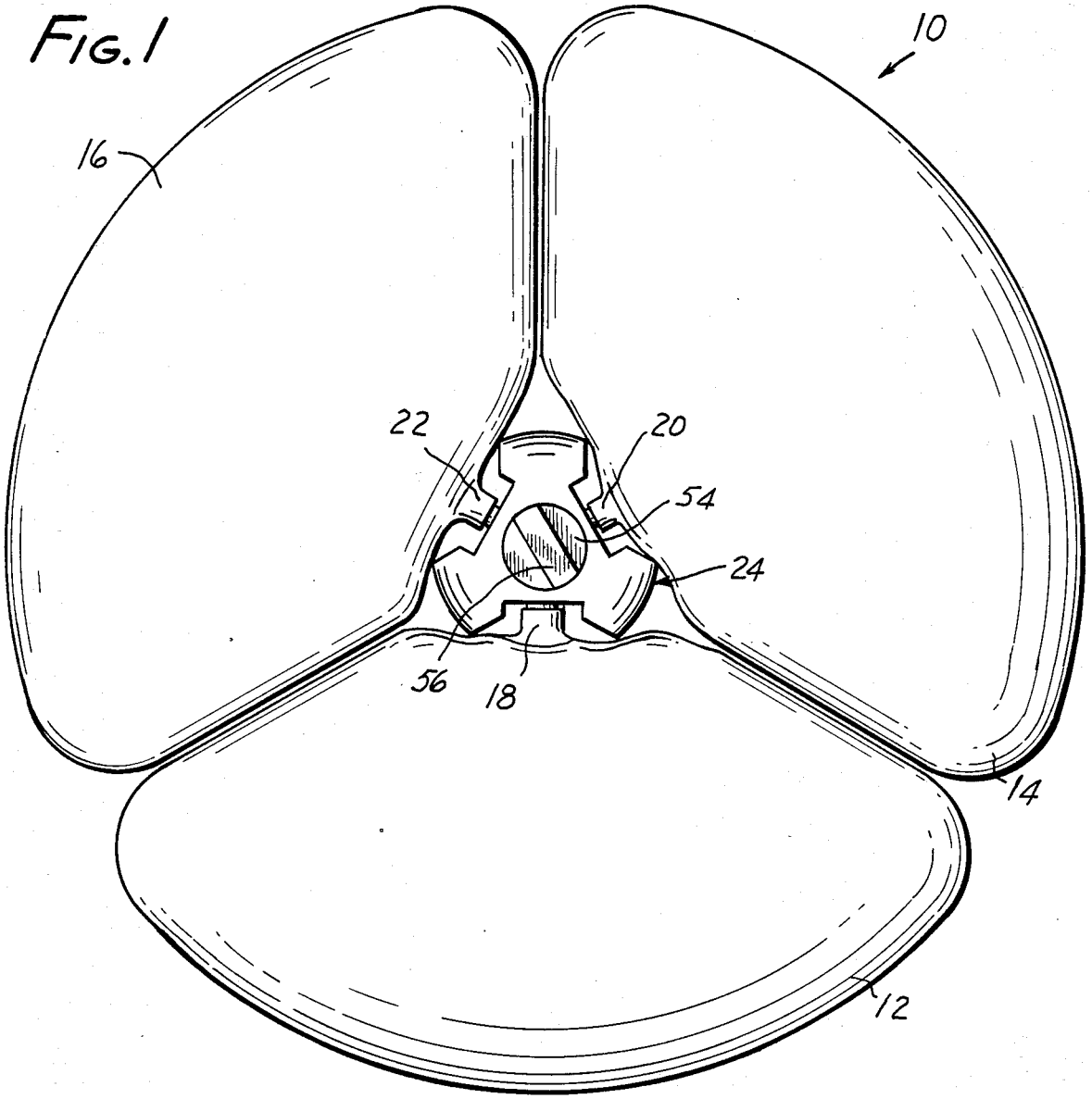

This invention has to do with water rescue aids, and more particularly with a hurlable apparatus which has the attributes of a ball for purposes of accurate throwing toward a victim some distance from a lifeguard, but which after landing functions as a life preserver when grasped by the victim.

The invention is specifically concerned with provision of a simply constructed, easily operated, reliable and highly portable and storable device for water emergency aid at a distance from boat, shoreline or other safe area. Hurling the present aid toward the person to be rescued enables commencement of rescue well before a lifeguard or lifeboat can be at the scene, saving valuable seconds and lessening panic in the victim.

BACKGROUND ART

It is well known to provide flotation aids to would-be drowning victims and others stranded in the sea, lake, river or flood waters. Usually such aids are carried to the victim by a lifeguard or other rescue personnel who use the aid to keep the victim calm and as an alternative to the victim clutching the rescuer with possible fatal results to both victim and rescuer. The problem with this usual, personal delivery approach is that important seconds are lost in effecting rescue since the rescuer has to haul the flotation aid device with him to the victim and can do so only at swimming or boat speeds. In the interim the victim may panic and be lost.

Rescue aid devices which can be thrown toward a victim are known but are generally short range. Thus, the conventional life preserver has the advantage of simplicity and reliability but is awkward to place accurately at any significant distance due to its bulk and doughnut configuration. Other devices, less well known, have been described in the patent literature as useful in providing flotation and in some cases as being projectable to a victim, but these devices appear to depend on chemical, electrical, or explosive actuation and will suffer reliability problems if stored for any length of time before use, particularly in marine environments.

In U.S. Pat. No. 3,812,546 to Witte for example, a spherical shell encloses a toroidal tube and a gas bomb for inflating the tube. Upon contact with water, a strap normally blocking release of gas into the tube for inflation, dissolves, and the released gas inflates the tube giving a flotation device. This apparatus while indicated to be an improvement over pellet activated release devices still is likely to suffer reliability difficulties since its effective operation is dependent on a chemical reaction which can vary with water temperature, water salinity, embrittlement of the strap and degradation of the chemical constituents of the strap, all such processes occuring at an unknown rate over time. In U.S. Pat. No. 3,693,202 to Ohtani another ball device is disclosed, this one responsive to sea water contact with a water soluble tablet to permit discharge of gas from a bomb into the toroidal tube to form a life ring. Again, problems of deterioration of the water soluble tablet over storage time, and water temperature differences can greatly affect performance, an unwanted risk in what is a life and death situation.

A mechanical, rather than chemical, operation is to be preferred. In U.S. Pat. No. 3,070,818 to Fairchild a flotation device is described in which release of compressed gas is effected by manual displacement of a plug. The Fairchild device is not a throwable rescue device, but is intended to be worn at all times by a swimmer who suspects there may be difficulties for him in the water. The device in addition to the inherent problem of having to be worn by a potential victim before it can be useful, unlike the throwable chemical devices discussed above, also suffers from a need to be operated by the victim, a not likely circumstance for reliable operation. A similar device having the advantage of mechanical operation and the disadvantage of requiring victim operation is shown in U.S. Pat. No. 2,173,567 to Shafer. The Shafer life saving apparatus is designed to be worn attached with a bathing suit, this was in 1938 when presumably bathing suits could conceal such an appliance, and for operation required the victim to plunge a needle point into a cartridge and release the gas.

A truly long distance life saving cartridge is taught in U.S. Pat. No. 2,496,479 to Kochner et al. There a grenade launcher, which is of course unlikely to be available at most beaches and rivers, is used to fire a "projectile" toward a victim. Percussion resultant from the projectile hitting the water starts a chain reaction among strings and levers and releases compressed gas into a flotation tube. Apart from the impracticality of the launch mode, the critical sequencing of impact, springs and levers makes this a probably unreliable device, unduly costly, and in all events prone to failure through rusting of the components in a marine environment.

In U.S. Pat. No. 3,059,253 to Sager a buoyancy device which generates a lightweight foam in response to water contact is described, enabling a compact rescue aid but requiring a chemical reaction to obtain flotation and thus subject to all the problems of water variation, temperature variation and progressive deterioration in the foam precursors while awaiting use.

An electrically responsive apparatus is disclosed in U.S. Pat. No. 4,094,028 to Fujiyama et al. There gas is generated in situ by electrical decomposition of selected compounds, all triggered by an electrical ignition. While the use of compressed gas cartridges is avoided, far less certain sources of gas are substituted, all at considerable expense and with many chances for operative failure in the complex chain of elecrochemical reactions needed to take place in prescribed sequence.

DESCRIPTION OF THE INVENTION

It is therefore among the objects of the invention to avoid the complexities and expense in previous throwable water rescue devices, and to provide a device which is mechanically controlled, and independently of victim participation, sized and shaped to be hurlable with great accuracy over considerable distances, immune to chemical and mechanical failure in storage, reusable by simple replacement of a few expendable parts, portable so as to be carryable on a lifeguard's belt for example, low in cost, and simple and direct in operation.

Other objects will appear in the ensuring description.

These and other objects of the invention to become apparent hereinafter are realized in accordance with the invention in a hurlable, water rescue aid comprising an initially collapsed, gas-inflatable buoyancy element, a ball-shaped bracket supporting the buoyancy element in collapsed condition generally within the locus of the bracket, a compressed gas supply within the bracket for inflating the element, means adapted to release the gas supply from compression in advance of hurling the aid toward a person to be rescued, and means metering flow of released gas from the supply into the buoyancy element, whereby the buoyancy element is substantially collapsed at the commencement of flight but substantially inflated at the termination of flight for use by the person to be rescued or his rescuer in effecting rescue.

In particular embodiments, the rescue aid buoyancy element comprises an inflatable bladder having a neck portion, the metering means communicating with the interior of the bladder through the neck; the bracket defines a buoyancy receiving recess within which the metering means terminates; the compressed gas supply comprises a cylinder having a frangible seal and containing a compressed gas under at least several atmospheres of pressure for release upon rupture of the seal; the metering means comprises a passage between the gas supply and the inflatable buoyancy element, the passage being dimensioned to relatively restrict gas flow into the element so that the element does not fully inflate during flight toward the person to be rescued; and the means for releasing the gas supply is externally adjustable relative to the bracket in advance of flight without inflating the buoyancy element.

In a particularly preferred embodiment there is provided in accordance with the invention, a water rescue aid comprising an initially collapsed, gas-inflatable buoyancy element, a compressed gas supply to the element, a ball-shaped buoyancy element bracket adapted for hurling by hand a considerable distance to a person to be rescued, the bracket defining an outwardly opening recess for receiving the buoyancy element in collapsed condition generally within the locus of the ball-shaped bracket, an interior plenum defined by the bracket for containing released gas supply, and a gas passage between the plenum and the interior of the buoyancy element, the gas passage acting to meter gas flow between the plenum and the buoyancy element, whereby the buoyancy element is substantially collapsed at the commencement of flight but substantially inflated after the flight for use by the person.

In such and like embodiments, the invention further includes a plurality of buoyancy elements, each of the elements comprising an inflatable bladder having a neck portion, the gas passage communicating the plenum with the interiors of the bladders through their respective necks; the bracket is about the size of a softball, and defines a buoyancy element-receiving recess for each bladder, the recesses being circularly distributed about the plenum; a cover means for each the recess forming a continuation of the surface of the ball-shaped bracket, the cover means being separable from the bracket responsive to inflation of the bladder therebeneath in bladder-uncovering relation during aid flight; the compressed gas supply comprises a cylinder having a frangible seal and containing a compressed gas under at least several atmospheres of pressure for release upon rupture of the seal, the cylinder having communication with the plenum upon rupture of the seal, and means to rupture the seal comprising a penetrating tip movable into the seal in advance of flight; the plenum extends within the bracket and opens outwardly in gas cylinder receiving relation to expose the seal of the cylinder therewithin, a gas-tight cap for the plenum, the cap carrying the penetrating tip for rupturing the seal responsive to inward movement of the cap relative to the bracket, the cap being movable in advance of aid flight; a cooperating pin and socket means defined by the plenum and the cylinder whereby the cylinder is kept positioned within the plenum for tip penetration of its seal upon cap movement; the gas passage comprises a series of separate passageways extending between the plenum and each of the bladders respectively, the passageways being dimensioned to relatively restrict gas flow into the element so that the element does not fully inflat during flight toward the person to be rescued; and also a series of plugs defining the passageways and having enlarged heads, the bladder necks being secured onto the plug heads for inflation of the bladders in metered relation.

In a highly specific form of the invention there is provided a hurlable, water rescue aid comprising a plurality of initially collapsed, gas-inflatable elastomeric bladders constructed and arranged to define segments of a circle when inflated, a compressed gas cylinder having a frangible seal and containing gas for inflating the bladders, a rigid resin ball defining a bracket for the cylinder and the bladders, the ball being about the size and weight of a softball and having a central bore into which the cylinder is uprightly received with its frangible seal outwardly exposed, the bore having an internally threaded mouth, and a circularly distributed series of vertical recesses into which the bladders are receiveable, separable covers for the recesses adapted to overlie the bladders as a continuation of the ball surface, a plenum cap comprising a threaded body adapted to screw into the mouth of the bore, a penetrating tip carried by the cap for rupturing the cylinder seal responsive to the cap being threaded into the bore, the bore thereby defining a plenum centrally of the ball, a series of gas passages between the plenum and the bladders, the gas passages comprising plugs restricting gas flow to enable ball flight free of bladder full inflation despite rupture of the cylinder seal before initiation of flight, whereby the bladders are sufficiently collapsed until termination of flight adjacent a person to be rescued to permit accurate and distant hurling of the aid.

THE DRAWINGS

The invention will be further described as to an illustrative embodiment in connection with the attached drawings in which:

FIG. 1 is a plan view of the present water rescue aid, inflated as for use.

Figure 2:
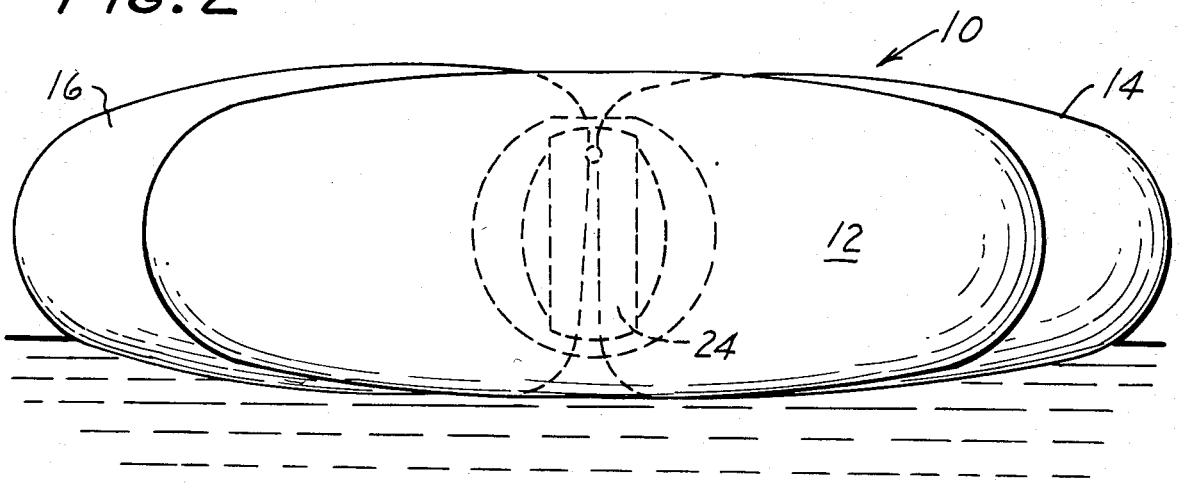
Figure 3:
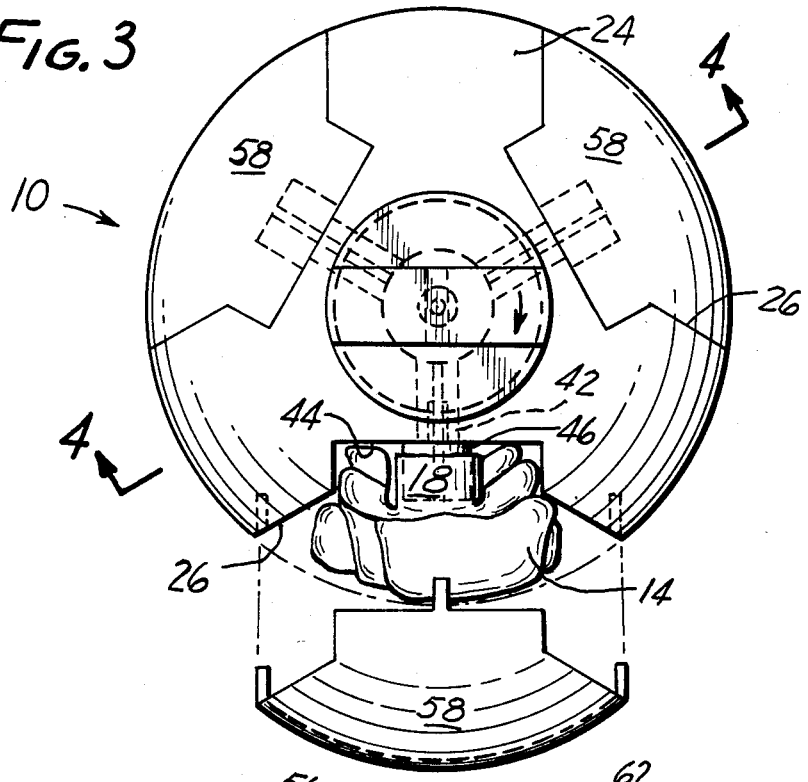
Figure 4:
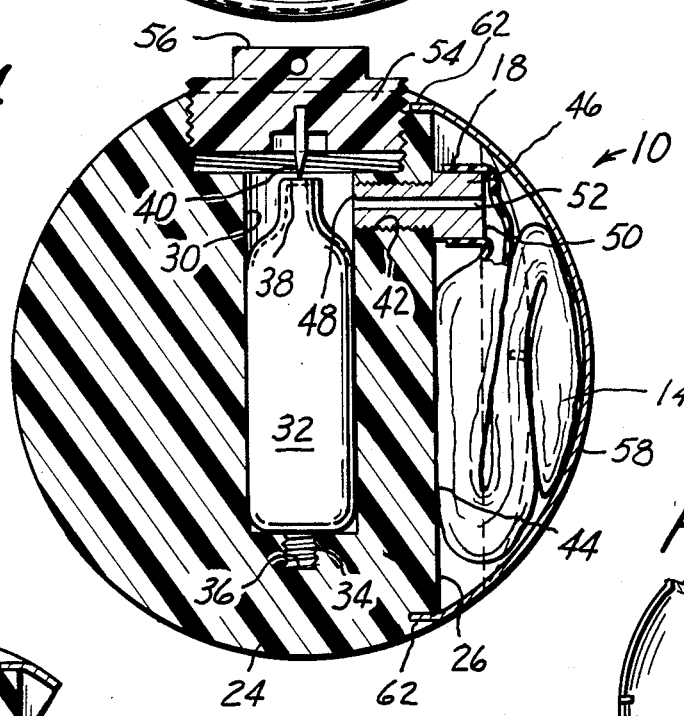
Figure 5:
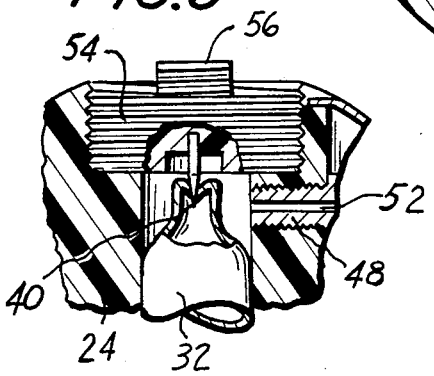
Figure 6:
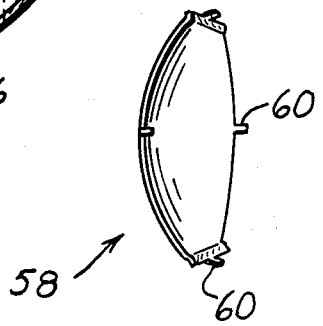

FIG. 2. is a side elevation view thereof;

FIG. 3. is a plan view of the present water rescue aid before inflation, and ready for hurling, with a portion broken out to show the underlying bladder collapsed for storage and before inflation;

FIG. 4. is a view in vertical section along the axis of the rescue aid, showing the compressed gas cylinder and associated bladder in elevation;

FIG. 5. is a fragmentary view of the gas cylinder seal penetrating tip in detail; and, FIG. 6. is a perspective view of one of the separable covers according to the invention.

PREFERRED MODES

It will be apparent in the following description that simplicity of production and use, mimimum moving parts, mechanical reliability, reusability, and compactness have been the desiderata in the aid design. What has been realized is a device that can be accurately thrown by virtue of its ball-shaped configuration and weight, but which is ready for use when it lands by the victim. In the past, see the discussion of prior art patents above, a water rescue device had to be either ready for use before being thrown to a victim, or generated after being thrown. By the ingenious use of metering passageways leading from a common central plenum filled on demand by a gas cylinder, the present device offers immediately upon landing the flotation characteristics of bulky, unthrowable apparatus without the delay inherent in chemical and electrical apparatus, and as well the hurling characteristics of a ball for accuracy and distance.

These seemingly contradictory requirements are realized by fully releasing the gas from the gas cylinder by a simple, manual movement in advance of throwing and by the rescuer, not the victim, and then metering the gas into the bladders during the average four or five second flight at a rate calculated with reference to such a flight time, to provide inflation for flotation only at the end of the aid flight whereby accuracy and distance are preserved for flight, but the victim is given immediate succor.

With reference now to the drawings in detail, the inflated water rescue aid is shown at 10 in FIGS. 1 and 2 and comprises a plurality of e.g., three identical buoyancy elements, namely gas-inflated bladders formed by pie-wedge-shaped perimetrically arcuate circle segments 12, 14 and 16. The bladders 12, 14 and 16 which can be of other useful shapes are fabricated of rubber or elastomeric plastic composition resistant to tearing, cracking upon folding, oxidation, and are of course water-proof. Each bladder 12, 14, 16 has an integral neck portion 18, 20, 22 which is used to fill the bladder as hereinafter described, and as well used to secure the bladder to the bracket 24. The bracket 24 thus serves as a central support for the bladders 12, 14, 16 in inflated condition, as shown. The invention water rescue aid 10 achieves the configuration shown in FIGS. 1 and 2, which would be only awkwardly throwable, only after flight as will be explained subsequently.

With reference now to FIGS. 3 to 5, the water rescue aid bracket 24 is formed of synthetic organic plastic in a size, shape and weight to approximate a softball for maximum convenience in throwing. The bracket 24 has three recesses 26 defined in its outer surface generally in the shape of an orange segment and symmetrically circularly spaced. Each recess 26 extends radially into the body of bracket 24 a distance to receive all of a bladder, e.g. the bladder 14, therein within the locus of the ball-shaped bracket. In this manner the ball-like characteristic is retained in the throwable device. The bladders 14, 16, 18 are collapsed upon themselves as shown in order to fit within the recesses 26. The size of the bladders 14, 16, 18 may vary depending on the flotation characteristic desired in the aid 10, and thus the size and shape of the recesses 26 may also vary to accommodate the folded bulk of the bladders. The placement and number of the bladders like bladder 14 can be varied and the number and placement of the recesses 26 as well, from the symmetrical pattern shown. It is anticipated that a victim will place his body atop the inflated device, so that a toroidal shape is not required, whereby the low ratio of flotation to area characteristic of a toroidal device may be avoided.

As best shown in FIG. 4, the bracket 24 defines an axial bore 30 into which is fitted a compressed gas cylinder 32, the cylinder containing gas under at least several atmospheres of pressure, e.g. 7 atmospheres, and having a threaded pin 34 attached thereto for cooperating interfittment with internally threaded socket 36 to stabilize the cylinder against tipping within the bore, to maintain the cylinder frangible seal, at 38, in registry with the seal rupturing means, penetrating tip 40. Upon gas discharge from the cylinder 32, the axial bore 30 becomes a plenum, for purposes to appear.

A series of radially disposed bores 42 extend between the axial bore 30 and the base walls 44 of the several recesses 26. A plug 46 comprising a threaded shank 48 and enlarged head 50 is gas tightly inserted in each radial bore 42. The plug 46 defines a central passageway 52 which communicates the axial bore 30 with the recess 26. It will be noted that the passageway 52 is of greatly reduced diameter for the purpose of metering gas released into the axial bore 30 and blocking a simple rush of gas out of the plenum defined by the axial bore. In prior art devices, the gas is released from the cylinder at the victim's location and speed is desirable. Therefore, prior art devices did not attempt or want to meter gas flow. The present device departs from this practice and uses a slow fill technique, but one which is commenced upon throwing and thus is at least as effective as on-site filling in terms of providing flotation support to a victim awaiting rescue.

The length and diameter of the passageways 52 is calculated, given a particular cylinder pressure, and the size of the bladders to be filled, so that from four to five seconds is required to fill the bladders, this being the time of flight approximately at a maximum distance.

The plug 46 empties into the bladder 14, 16, 18. Referring to bladder 14 as typical, the bladder is attached by its neck portion 18 being overfitted onto plug 46, secured there by cement or an external ring (not shown) or other suitable means.

Completing the assembly of the bracket 24 is plenum cap 54 which threads into the open end of axial bore 30. It will be noted that plenum cap 54 carries penetrating tip 40 juxtaposed to seal area 38 on the cylinder 32. It will be further noted, particularly in comparing FIGS. 4 and 5, that cap 54 is generally only partly threaded into bore 30 so that tip 40 does not contact seal 38, and so that a fair portion of the cap projects above the ball bracket 24. It is this projecting portion that is grasped by a lifeguard or other user, who turns the cap inward to release the gas from the cylinder, see FIG. 5. This simple screwing motion can be quickly performed, is mechanical in nature and does not admit of failure or inoperability. Because the bracket 24 is typically formed of synthetic organic plastic materials such as acrylic, polyolefin, e.g. polyethylene or polypropylene, or styrene copolymer, and the cap 54 of like material, the threading action is smooth, reliable and unlikely to malfunction, even after a long period on nonuse. Similarly, the penetrating tip 40 is shielded within the bracket bore 30 and is thus maintained sharp and ready for use when an emergency arises. To operate the cap 54 is simply screwed down, e.g. until it seats, as shown in FIG. 5. The cap 54 has a boss 56 which suitably is cross-bored to enable hanging the bracket 54 from a belt loop on a bathing suit, or from a hook in a lifeguard tower.

A further feature of the present invention is the provision of protective covers 58 over each of the recesses 26. The cover 58 comprises a thin shell-like structure, best shown in FIG. 6, which has perimetrically distributed tabs 60 to interfit apertures 62 in the bracket 24. The tabs 60 are typically of rectangular, e.g. square cross-section, and enter the bracket apertures chordally so as to be separable from the body upon expansion of the bladder 14, 16, or 18. The covers 58 are sized and shaped to form a smooth continuation of the surounding ball surface when full installed.

The mode of operation of the invention water rescue aid can now be described. When a person to be rescued is noticed, the lifeguard grasps the bracket 24, turns the cap 54 to push the tip 40 through the frangible seal on the gas cylinder. The bore 30 is simultaneously gas tightly sealed, becoming a plenum as the gas is released from the cylinder. The gas seeks out the passageways 52 in the plugs 46. Meantime, the lifeguard has begun a throwing motion, treating the bracket 24 as a softball aiming just short of the potential rescuee. At the point of launch, the aid 10 has covers 58 in place and is for all intents and purposes a ball. The gas released by the cylinder 32, however, is entering the bladders 12, 14, 16. By design, the rate of bladder inflation is such that preferably only on the downward trajectory of the aid 10 are the covers 58 separated and the bladders theretofore confined allowed to emerge. Once freed, the bladders continue to inflate at the predetermined rate fixed by the metering passageways 52 of the plugs 46, in such manner that upon arrival at the vicinity of the victim, the bladders are nearly filled and a useful flotation device provided. The lifeguard of course is swimming to the victim as rapidly as possible, unencumbered by any other rescue apparatus, and thus more swiftly than if the present apparatus was not being used, and withal the victim is supported in the water while awaiting personal aid.

The above-mentioned objects are thus met in that there is provided a simply constructed, easily operated, reliable, portable rescue device which can be hurled to the victim, saving valuable time and precious lives thereby.

I claim:

1. Hurlable, water rescue aid comprising a plurality of initially collapsed, gas-inflatable buoyancy elements each having a neck portion, a ball-shaped bracket supporting said buoyancy elements in collapsed condition generally within the locus of said bracket, a compressed gas supply within said bracket for inflating said elements, means adapted to release said gas supply from compression in advance of hurling said aid toward a person to be rescued, and means metering flow of released gas from said supply into each said buoyancy element comprising a passageway of greatly reduced diameter relative to said buoyancy element neck portion, whereby each said buoyancy element is substantially collapsed at the commencement of flight but substantially inflated at the termination of flight for use by said person.

2. Hurlable, water rescue aid according to claim 1, in which said buoyancy element comprises an inflatable bladder having a neck portion, said metering means communicating with the interior of said bladder through said neck.

3. Hurlable, water rescue aid according to claim 1, in which said bracket defines a buoyancy element receiving recess within which said metering means terminates.

4. Hurlable, water rescue aid according to claim 1, in which said compressed gas supply comprises a cylinder having a frangible seal and containing a compressed gas under at least several atmospheres of pressure for release upon rupture of said seal.

5. Hurlable, water rescue aid according to claim 1, in which said metering means comprises a passage between said gas supply and said inflatable buoyancy element, said passage being dimensioned to relatively restrict gas flow into said element so that said element does not fully inflate during flight toward said person to be rescued.

6. Hurlable, water rescue aid according to claim 1, in which said means for releasing said gas supply is externally adjustable relative to said bracket in advance of flight without inflating said buoyancy element.

7. Hurlable, water rescue aid comprising a plurality of initially collapsed, gas-inflatable buoyancy elements each having a neck portion, a compressed gas supply to each said element, a ball-shaped buoyancy element bracket adapted for hurling by hand a considerable distance to a person to be rescued, said bracket defining an outwardly opening recess for receiving each said buoyancy element in collapsed condition generally within the locus of said ball-shaped bracket, an interior plenum defined by said bracket for receiving released gas supply, and a gas passage of reduced diameter relative to said neck portion between said plenum and the interior of each said buoyancy element, said gas passage acting to meter gas flow between said plenum and said buoyancy element, whereby each said buoyancy element is substantially collapsed at the commencement of flight but substantially inflated after the flight for use by said person.

8. Hurlable, water resuce aid according to claim 7, including also each of said elements comprising an inflatable bladder having a neck portion, said gas passage communicating said plenum with the interiors of said bladders throught their respective necks.

9. Hurlable, water rescue aid according to claim 8, in which said bracket is about the size of a softball, and defines a buoyancy element-receiving recess for each bladder, said recesses being circularly distributed about said plenum.

10. Hurlable, water rescue aid according to claim 9, including also cover means for each said recess forming a continuation of the surface of said ball-shaped bracket, said cover means being separable from said bracket responsive to inflation of the bladder therebeneath in bladder uncovering relation during aid flight.

11. Hurlable, water rescue aid according to claim 10, in which said compressed gas supply comprises a cylinder having a frangible seal and containing a compressed gas under at least several atmospheres of pressure for release upon rupture of said seal, said cylinder having communication with said plenum upon rupture of said seal, and means to rupture said seal comprising a penetrating tip movable into said seal in advance of flight.

12. Hurlable, water rescue aid according to claim 11, in which said plenum extends within said bracket and opens outwardly in gas cylinder receiving relation to expose the seal of said cylinder therewithin, a gas-tight cap for said plenum, said cap carrying said penetrating tip for rupturing said seal responsive to inward movement of said cap relative to said bracket, said cap being movable in advance of aid flight.

13. Hurlable, water rescue aid according to claim 12, including also cooperating pin and socket means defined by said plenum and said cylinder whereby said cylinder is kept positioned within the plenum for tip penetration of its seal upon cap movement.

14. Hurlable, water rescue aid according to claim 12, in which said gas passage comprises a series of separate passageways extending between said plenum and each of said bladders respectively, said passageways being dimensioned to relatively restrict gas flow into said element so that said element does not fully inflate during flight toward said person to be rescued.

15. Hurlable, water rescue aid according to claim 14, including also a series of plugs defining said passageways and having enlarged heads, said bladder necks being secured onto said plug heads for inflation of said bladders in metered relation.

16. Hurlable, water rescue aid comprising a plurality of initially collapsed, gas-inflatable elastomeric bladders constructed and arranged to define segments of a circle when inflated, a compressed gas cylinder having a frangible seal and containing gas for inflating said bladders, a rigid resin ball defining a bracket for said cylinder and said bladders, said ball being about the size and weight of a softball and having a central bore into which said cylinder is uprightly received with its frangible seal outwardly exposed, said bore having an internally threaded mouth, and a circularly distributed series of vertical recesses into which said bladders are receiveable, separable covers for said recesses adapted to overlie said bladders as a continuation of the ball surface, a plenum cap comprising a threaded body adapted to screw into the mouth of said bore, a penetrating tip carried by said cap for rupturing said cylinder seal responsive to said cap being threaded into said bore, said bore thereby defining a plenum centrally of said ball, a series of gas passages between said plenum and said bladders, said gas passages comprising plugs restricting gas flow to enable ball flight free of bladder full inflation despite rupture of said cylinder seal before initiation of flight, whereby said bladders are sufficiently collapsed until termination of flight adjacent a person to be rescued to permit accurate and distant hurling of said aid.

* * * * *